US005853137A

United States Patent [19]

Straaten et al.

[11] Patent Number: 5,853,137

[45] Date of Patent: Dec. 29, 1998

[54] CHEESE-PRODUCING TEXTILE MACHINE

[75] Inventors: Paul Straaten, Kerken; Ulrich Fechter, Mönchengladbach; Dieter Spinnen, Mönchengladbach; Jürgen Enger, Mönchengladbach; Hermann-Josef Vest, Mönchengladbach, all of Germany

[73] Assignee: W. Schlafhorst AG & Co., Moenchengladbach, Germany

[21] Appl. No.: 985,020

[22] Filed: Dec. 4, 1997

[30] Foreign Application Priority Data

Dec. 7, 1996 [DE] Germany ..... 196 50 932.7

[51] Int. Cl.[6] ..... B65H 54/26

[52] U.S. Cl. ..... 242/473.6

[58] Field of Search ..... 242/473.6, 473.7, 242/473.8

[56] References Cited

U.S. PATENT DOCUMENTS

| | | | |
|---|---|---|---|
| 4,541,578 | 9/1985 | Kawarabashi et al. | 242/473.6 |
| 5,165,615 | 11/1992 | Polinik | 242/473.6 |
| 5,299,750 | 4/1994 | Nakagawa et al. | 242/473.6 |
| 5,326,039 | 7/1994 | Tanae et al. | 242/473.8 |
| 5,426,929 | 6/1995 | Schwalm et al. | 242/473.8 X |
| 5,634,603 | 6/1997 | Raasch et al. | 242/473.6 |

FOREIGN PATENT DOCUMENTS

| | | |
|---|---|---|
| 39 02 182 | 8/1989 | Germany . |
| 42 21 504 | 2/1996 | Germany . |
| 195 20 132 | 12/1996 | Germany . |

*Primary Examiner*—Michael Mansen

*Attorney, Agent, or Firm*—Kennedy Covington Lobdell & Hickman, LLP

[57] ABSTRACT

A cheese-producing textile machine 1 having a plurality of winding stations 2 with respective separate winding station computers 39 and a unit 23 for servicing the winding stations 2. The textile machine 1 has a central control unit 37 and the service unit 23 has a separate control computer 38. These control devices 37, 38 and 39 are connected with each other by means of a machine bus 40. During the process of replacing a finished cheese with an empty tube at any winding station, a cheese brake integrated into the winding creel 18 and/or a creel lifting device 49 can be actuated by the service unit computer 38 via the machine bus 40 in a pulsed manner when needed, for example to dislodge a cheese 11 which is stuck in the winding creel.

7 Claims, 4 Drawing Sheets

CHEESE-PRODUCING TEXTILE MACHINE

FIELD OF THE INVENTION

The present invention relates to a cheese-producing textile machine equipped with a plurality of winding stations, each of which has a winding station computer and a winding device for creating a cheese while supported by a winding creel having devices for holding and manipulating the cheese, and also equipped with a service unit for servicing the winding stations, the service unit having manipulating devices for removing a finished cheese from the winding creel and for inserting an empty tube into the winding creel of the winding device, as well as means for transmitting control commands between the various control devices.

BACKGROUND OF THE INVENTION

German Patent Publication DE 39 02 182 A1, for example, describes a so-called automatic cheese winder with a plurality of winding stations, each of which has a separate winding station computer connected to a central control unit of the textile machine. A service unit, which services the winding station, is also connected to this central control unit. Via the central control unit and the winding station computers, the service unit can actuate the winding drive of each winding station such that, during the process of changing from a cheese to an empty tube, the yarn guide drum rotates at a circumferential speed which is changed in comparison with the "normal" winding process.

Another automatic cheese winder is disclosed in German Patent Publication DE 42 21 504 A1, whose winding stations are connected via a bus with a service vehicle. If a service requirement arises at one of the winding stations, the respective winding station issues an optical signal, which is detected by the service vehicle patrolling in front of the winding stations and, after it has been positioned at this winding station, the service vehicle issues a light signal as an acknowledgment to the winding station. The respective winding station is activated by this light signal, so that subsequently work orders, for example for rotating the drive roller in reverse, cleaning the winding station or the like, can be issued to the respective winding station from the service vehicle via the bus.

Service units which, when required, exchange cheeses wound in the winding stations of such automatic cheese winders for empty bobbin tubes, are also known and have been described, for example, in the later published German Patent Publication DE 195 20 132 A1. Such service units, commonly referred to as cheese changers, have a multitude of manipulation devices which allow them to remove a cheese from the winding creel of the respective winding station and to replace it by an empty tube. A yarn end originating at a spinning cop positioned in an unwinding position at the respective winding station will be subsequently fixed on the empty tube or between the empty tube and a rotatable component of the winding creel.

These known cheese changers have proven effective in actual use. However, difficulties can arise when conical empty tubes, which are made of cardboard or similar materials of relatively low strength, are being wound on the automatic cheese winders. In particular, it can occur that the empty bobbin tubes become widened in the area of their large diameter and then become stuck in the tube receiver of the winding creel. In such cases, an automatic tube exchange often is not possible and manual intervention must be made.

Difficulties can also arise in the course of fixing the yarn end between the front of an empty replacement tube and the tube receiver on the winding creel, in particular if the relatively sensitive empty cardboard tube is no longer in good order, i.e. if the empty tube is slightly depressed, for example, in the area of its large diameter, where a bottom reserve winding is customarily placed.

OBJECT AND SUMMARY OF THE INVENTION

Based on the above mentioned prior art, it is accordingly a basic object of the present invention to improve the security and reliability of the procedure in automatic cheese winders for replacing a finished cheese with an empty tube, in particular if sensitive conical empty tubes are used.

This object is attained in accordance with the present invention by means of a cheese-producing textile machine basically comprising a plurality of winding stations and a unit for servicing the winding stations. Each winding station has an openable creel device for winding a cheese, with the creel device having elements for holding and manipulating the cheese. The servicing unit is equipped with manipulating devices for removing a cheese from the creel device and for inserting an empty tube into the creel device of a respective winding station. Each winding station has an individual respective winding station computer, the servicing unit also has its own control computer, and the machine includes means for transmitting control signals between the winding station computers and the service unit computer. In particular, according to the present invention, the service unit computer has means for issuing a control command to any one of the winding station computers for the actuation of at least one of the cheese holding and manipulating elements thereof after opening of the creel device when necessary to assist in discharge of a finished cheese for replacement with an empty tube.

Fundamentally, the present invention has the advantage that no manual intervention by machine operators is required, even if there is a jamming of the tube of the cheese at the tube holder of the winding creel, for example because of an imperfect tube.

If, for example, a conical cheese formed about a cardboard tube, which has been widened in the area of its large diameter, has become stuck in the tube receiver of a winding creel, this condition is detected by the service unit by means of an appropriate sensor and the service unit, whose control computer is also directly connected via the machine bus with the winding station computer of the winding station which is just being serviced, initiates the respective winding station computer to positively actuate the actuating valve of the cheese brake, preferably several times briefly. As a rule, the cheese is usually released from the winding creel by means of the resultant jerking movement imposed on the associated tube receiver.

Correspondingly, it is also possible for the control computer of the service unit to initiate the winding station computer of the winding station via the machine bus for fixing the yarn end on the empty tube. In particular, it is possible by means of a positive actuation of the cheese brake to assure that the yarn, which is held in a tensioned state between the front of the bobbin tube and the tube receiver of the winding creel, is clamped by both oppositely located contact surfaces of the front of the tube.

In a preferred embodiment, the release of a cheese from the tube receiver is aided by the winding creel lifting device which can be positively actuated by the control computer of the service unit via the machine bus, in like manner as the actuation of the cheese brake.

By the appropriate actuation of a valve inserted into the pressure supply line it is possible to move the winding creel with a jerking motion and to effectively aid the release of the cheese from the winding creel.

In an advantageous embodiment, a pulse-like actuation of the cheese brake and/or the winding creel lifting device takes place. Short relative movements occur between the tube receiver of the winding creel, which is open at such time, and the cheese, because of the pulse-like actuation of the cheese brake, the result of which is that even cheese tubes which are stuck or jammed are safely released from the respective tube receivers.

Further details, features and advantages of the present invention will be understood from the following description of an exemplary embodiment with reference to the accompanying drawings.

DETAILED DESCRIPTION OF THE PREFERRED EMBODIMENT

Figure 1:
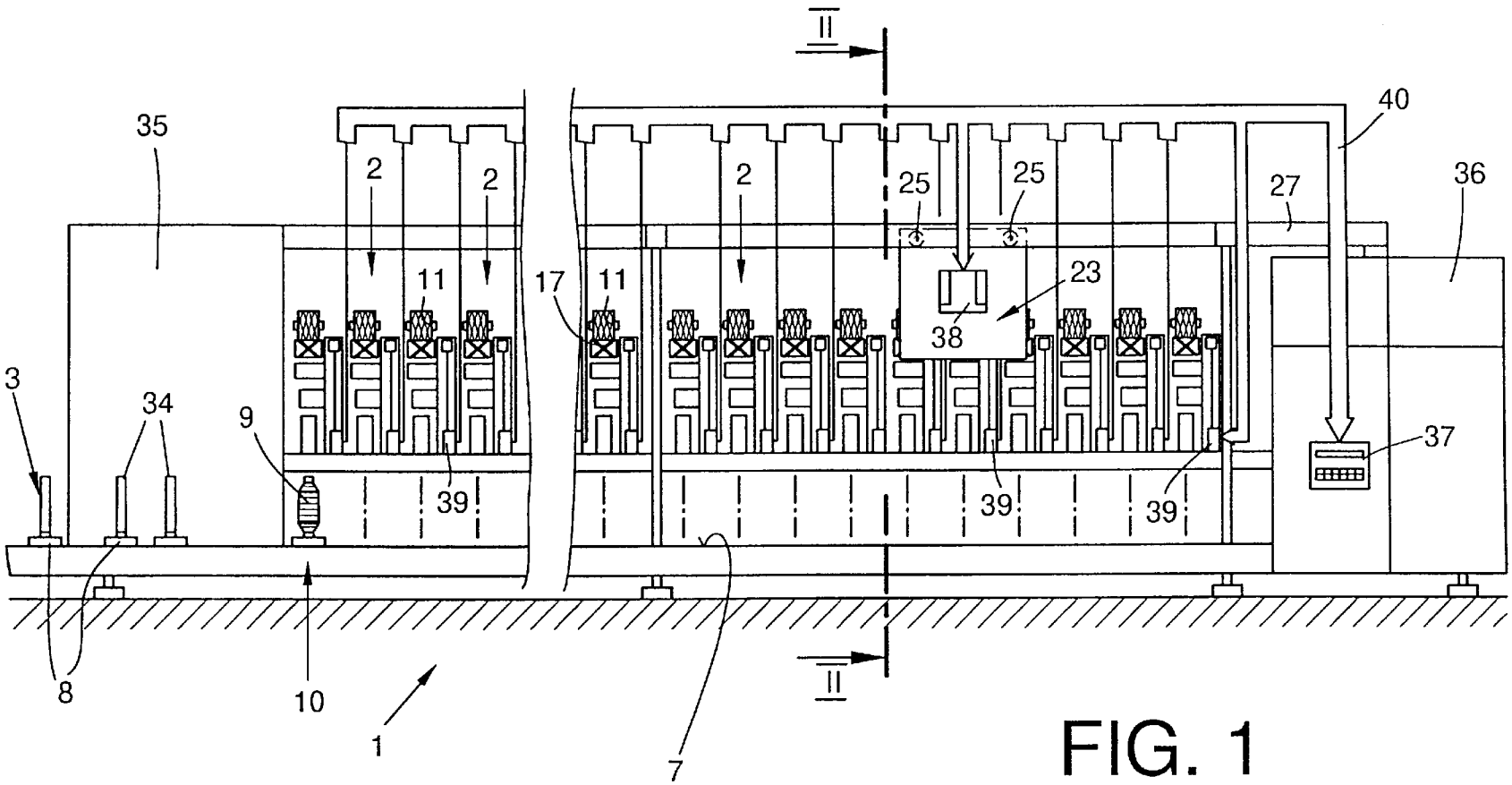
FIG. 1 is a front elevational view of a cheese-producing textile machine in accordance with the present invention, equipped with a traveling service unit which is connected via a machine bus with the winding stations of the machine.

A cheese-producing textile machine, preferably an automatic cheese winder in the exemplary embodiment, is schematically represented in FIG. 1 and identified as a whole by the reference numeral 1. Usually such automatic cheese winders have a plurality of essentially identical winding stations, in the present case winding stations 2, aligned with one another between end frames 35, 36, of the winder. Spinning cops 9, produced on a ring spinning machine (not shown), are rewound in these winding stations 2 into larger volume cheeses 11 in a manner which is well known and therefore not explained in detail.

The finished cheeses 11 are transferred onto a cheese transport device 21 by means of an automatically operating service unit, for example by means of a cheese changer 23, and are subsequently transported by the transport device 21 to a loading station (not represented) or the like arranged at the end of the machine.

In addition, such automatic cheese winders 1 are often equipped with a logistical system in the form of a transport system 3 by which spinning cops 9 and empty tubes 34 are circulated on transport plates 8 about this transport system 3 for delivery to and from the winding stations 2.

Such an automatic cheese winder 1 additionally has a central control unit 37, which is connected via a machine bus 40 with separate respective winding station computers 39 associated with the individual winding stations 2 as well as with the control computer 38 of the service unit 23 servicing the winding stations 2.

Figure 2:
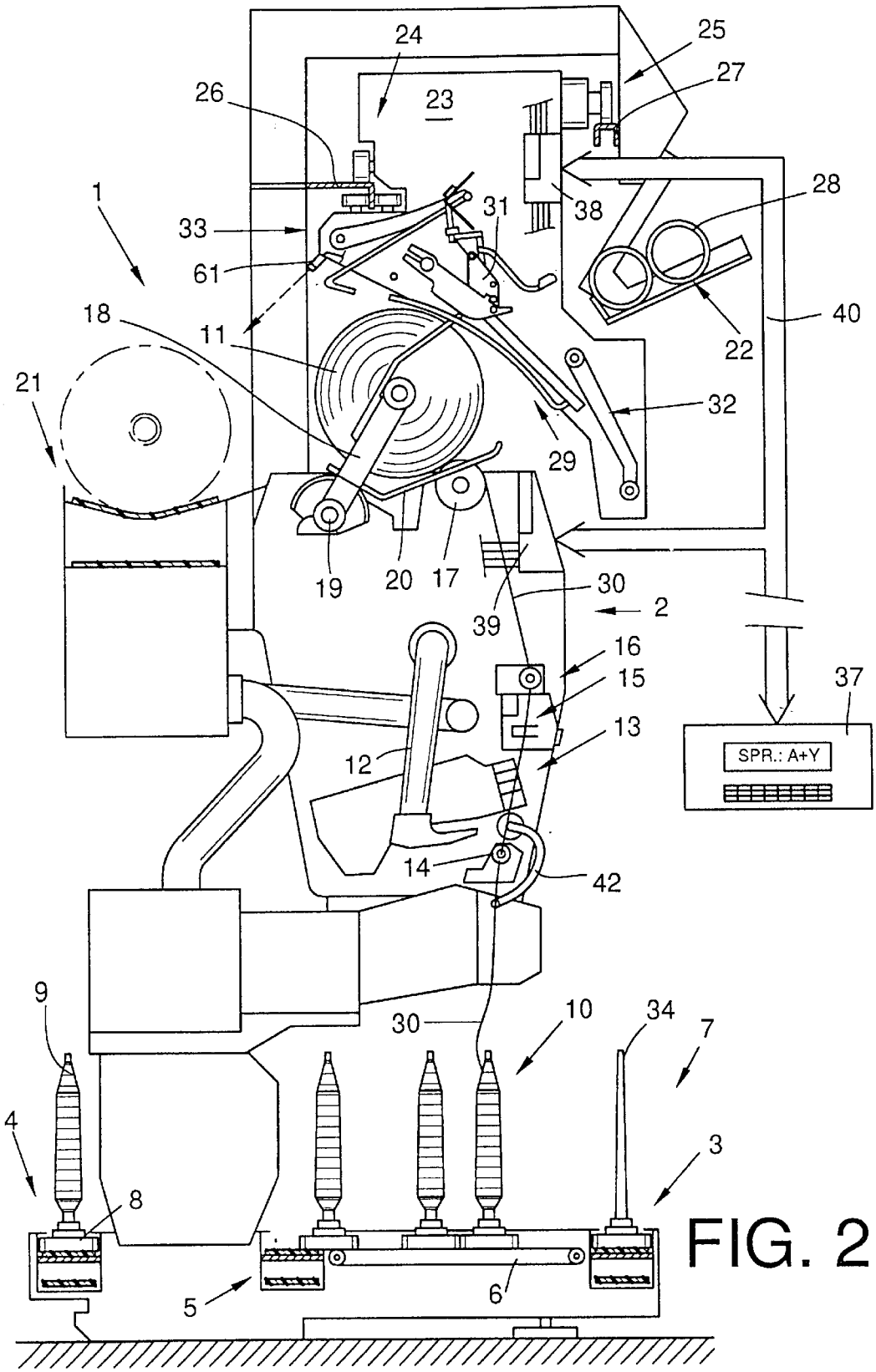
FIG. 2 is a lateral elevational view of a winding station of the automatic cheese winder of FIG. 1, with a cheese changer type of service unit positioned at the winding station, depicting the start of the process of exchanging a finished cheese with an empty replacement tube.

As can be seen in FIG. 2 in particular, the service unit 23 is movably supported by means of running gears 24, 25 on tracks 26, 27 extending the length of the machine above the winding stations 2 for traveling movement of the service unit 23 along the winding stations. The service unit 23 not only serves to transfer the cheeses 11 finished in the winding stations onto the cheese transport device 21, but also automatically places an empty replacement tube 28 into the winding creel of the respective winding station 2. In the process, the service unit 23 preferably takes the respective empty tube 28 out of an empty tube magazine 22, which is part of each winding station.

As already indicated above, such textile machines have a cop/empty tube transport system 3. Of this extensive transport system 3, only a main transport track 4 which extends over the length of the machine, an associated reversing cop supply track 5 which extends along the rearward sides of the winding stations 2, one of plural transverse transport tracks 6 each respectively leading to an associated one of the winding stations 2, and a return track 7 which also extends over the length of the machine at the opposite side from the main transport track 4, are represented in FIG. 2.

The spinning cops 9 transported along the cop/empty tube transport system 3 are delivered in sequence to unwinding stations 10 located along the transverse transport tracks 6 at the winding stations 2 for rewinding of the cops 9 into larger volume cheeses 11. As already known and only partially indicated schematically in the drawings, the individual winding stations 2 have various devices which assure an orderly operation of these winding stations.

FIG. 2 representatively depicts a yarn 30 traveling from a spinning cop 9 to a cheese 11 being wound at one winding station 2, with a suction nozzle at the winding station being represented at 12, a gripper tube being represented at 42, a splicing device being represented at 13, a yarn tensioning device being represented at 14, a yarn cleaner being represented at 15 and a waxing device being represented at 16.

A drive drum, which peripherally drives the cheese 11 during the winding process by frictional surface contact, is indicated at 17. During the winding process, the cheese 11 is held in a winding creel 18, which is pivotably seated on a shaft 19. A swivel plate 20 is arranged for limited pivotability below the winding creel 18, by which the finished cheeses can be transferred over the swivel plate 20 to the cheese transport device 21 extending behind the winding stations 2.

The winding stations 2 are serviced by means of the cheese changer service unit 23. In particular, as aforedescribed, the cheese changer 23 serves to transfer cheeses 11 which have attained a predetermined diameter onto the cheese transport device 21, and subsequently to insert an empty replacement tube 28 from the empty tube magazine 22 into the winding creel 18.

Some of the manipulating elements of the service unit 23 needed in the course of this process of exchanging a cheese with an empty tube are represented in FIG. 2: a creel opener 29, a creel lifter 32, a cheese guide device 33 and an empty tube feeder 31. For the sake of clarity, the representation of further manipulating elements of such cheese changers has been omitted in this drawing figure. The devices for preparing a tip reserve winding and the bottom reserve winding, for example, are not shown.

Figure 4:
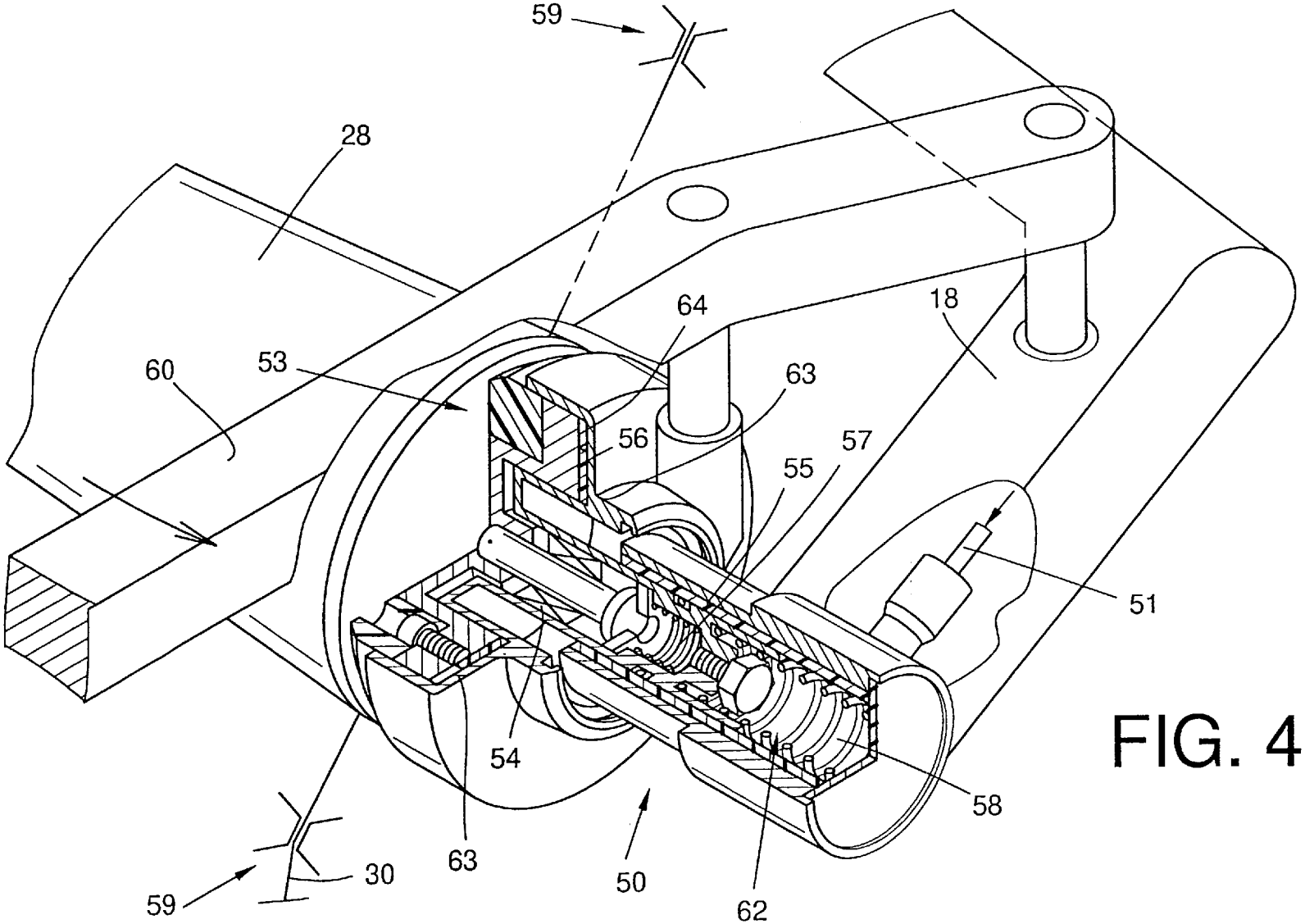
FIG. 4 is a perspective view, partially broken away, showing a pneumatically actuated cheese brake in detail.

The creel 18 includes a device schematically indicated in FIG. 4 at 59 for applying the yarn 30 to the empty replacement tube 28, and for tensioning the yarn 30 between the front of the empty tube 28 and the tube receiver 53 of the spinning creel 18.

Figure 3:
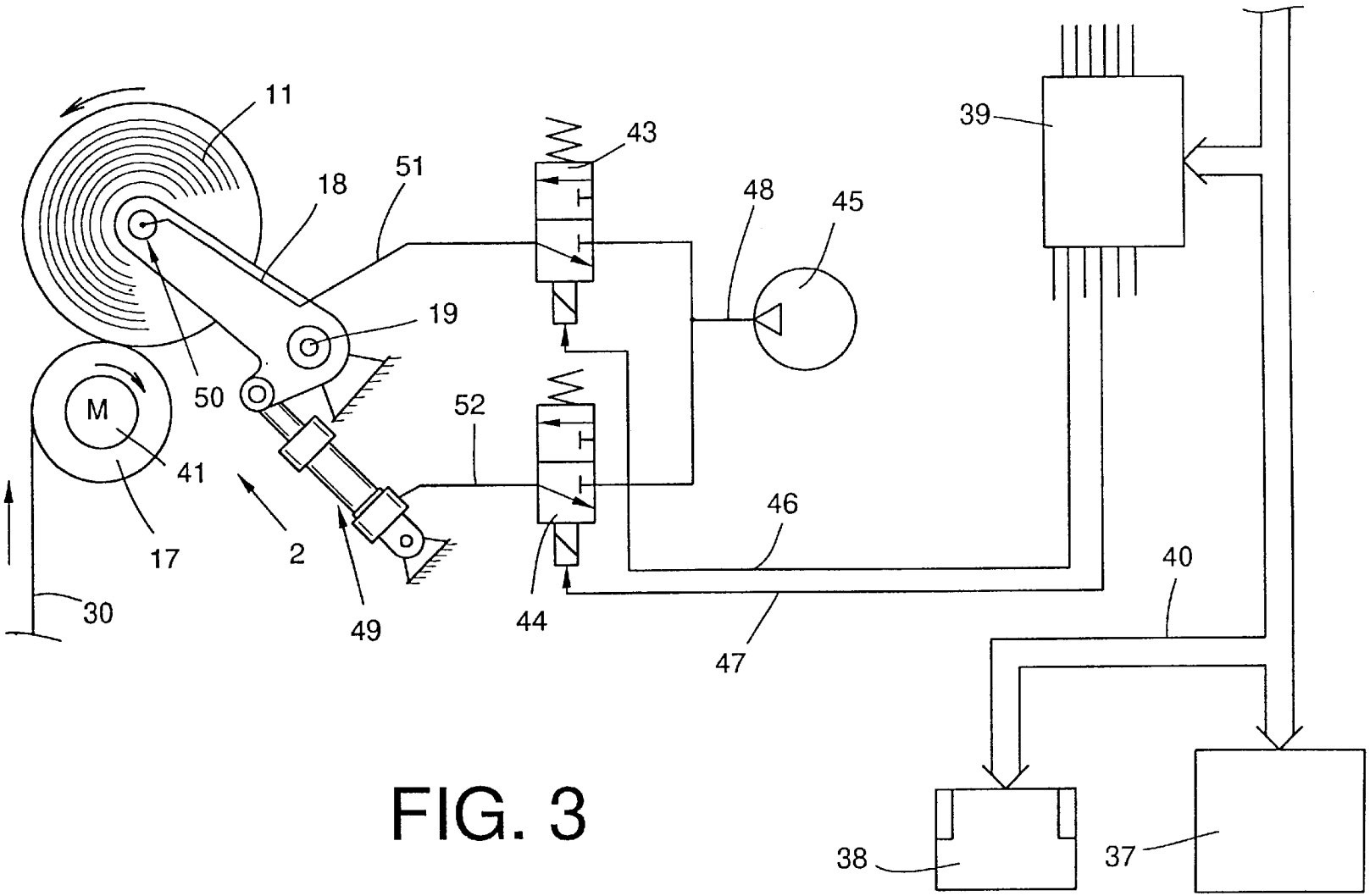
FIG. 3 is a schematic diagram representing the pneumatic and technical control equipment of a winding station.

As indicated in FIGS. 1 to 3, the textile machine 1 has a central control unit 37, arid the individual winding stations 2 have respective winding station computers 39. In addition, the service unit 23 has its own control computer 38. The central control unit 37 of the textile machine 1, the respective winding station computers 39, and the control computer 38 of the service unit 23 are connected with each other by means of a machine bus indicated only schematically at 40.

FIG. 3 shows additionally that a cheese brake 50, integrated into the spinning creel 18, as well as a winding creel lifting device 49 are connected with a compressed air source 45 via a main service line 48 and branch service lines 51, 52, in which controllable valve elements 43, 44 are disposed.

The valve elements 43, 44 associated with each respective creel 18 are connected via control lines 46, 47 to the individual winding station computer 39 of the respective winding station 2, whereby the respective cheese brake 50 as well as the winding creel lifting device 49 can be positively actuated by the respective winding station computer 39. The cheese brake 50, represented in greater detail in FIG. 4, is a pneumatically actuable device, which is known per se.

In basic operation, the cheese brake 50 can be charged with a pressure medium, for example air at a pressure of 3.5 bar, via the service line 51. The pressure medium flowing into the cylinder chamber 62 thus acts against the piston 55, which is configured as a sleeve-like element, and pushes the piston 55 against the force of a spring element 57 in the direction toward the tube receiver 53.

A cheese 11 or, as represented in FIG. 4, an empty tube 28, held between the arms of the winding creel 18 in resting abutment against the tube receiver 53 constitutes a counterseat in that, when the cheese brake 50 is acted upon by pressure, a brake shoulder 63 connected with the piston 55 presses against an axially movable brake pad 56 which is fixed against relative rotation and, thus, in turn is pushed against a rotatable brake surface 64 of the tube receiver 53. The brake pad 56 engaging against the brake surface 64 thereby prevents the further rotation of the tube receiver 53 and thus of the cheese 11.

As can be understood with reference to FIG. 4, a pulse-like actuation of the cheese brake 50, in particular if the winding creel 18 is opened, causes a brief axial movement of the tube receiver 53. Since a relatively heavy cheese which, for example, may be stuck in the tube receiver 53 because of a widened conical cardboard tube, cannot follow or will only incompletely follow this jerking movement of the tube receiver, the positive effect is to release the cheese 11 without manual intervention from the tube receiver 31.

The operation of the device of the present invention may thus be understood. When a cheese 11 has reached its predetermined diameter or its predetermined yarn length at one of the winding stations 2 of the automatic cheese winder 1, the yarn 30 is initially cut by means of a yarn cutting device 16 (FIG. 2), and the cheese is lifted off the drive drum 17 by the winding creel lifting device 49, and the cheese 11 as well as the drive drum 17 are braked to a standstill. In this case, braking of the cheese 11 is performed by means of the cheese brake 50, whose actuating valve 43 is appropriately activated by the associated winding station computer 39.

Since the service unit 23 can only grasp a traveling yarn 30, the cheese 11 is subsequently lowered onto the drive drum 17, and the cut ends of the yarn 30 are freshly spliced in a splicing device 13 of the winding station 2. In the meantime, the winding station computer 39 of the respective winding station 2 has transmitted a signal via the machine bus 40 calling the service unit 23 to the respective winding station, and the service unit 23 thereby immediately travels to and is positioned at the respective winding station.

At the respective winding station, the service unit 23 first picks up the spliced yarn 30 extending between the spinning cop 9 standing in the unwinding position 10 and the cheese 11 by means of a yarn lifter (not represented) in order to have the yarn ready for the subsequent changing and piecing process. Depending on the desired shape of the cheese 11, the yarn 30 may be cut, for example after the preparation of a top cone winding, by the service unit 23, with the service unit then holding the lower yarn coming from the spinning cop 9.

In the course of the changing process and after the application of the required top cone winding by the above described manipulation devices, the cheese 11 is transferred onto the cheese transport device 21. Specifically, an opening lever 60 of the winding creel 18 is pushed outwardly by means of the yarn lifter 29, so that the cheese 11 is placed onto the swivel plate 20 disposed below the creel. This swivel plate 20 is then pivoted to a limited extent about the pivot shaft 19 by the creel lifter 32, so that the cheese 11, while being guided by a cheese guide device 33, rolls onto the cheese transport device 21.

The correct arrival of the cheese 11 on the cheese transport device 21 is monitored, for example by means of an ultrasonic sensor 61 disposed on the service unit 23 and connected to the control computer 38. Thus, the control computer 38 of the service unit 23 is informed by an appropriate signal from the sensor 61 as to whether or not the cheese 11 has reached its correct position on the cheese transport device 21.

If the sensor 61 determines that the cheese 11 has not reached its correct position, this often indicates, mainly in winding operations utilizing conical tubes made of a relatively sensitive material, that the tube 28 of the cheese is still stuck in the tube receiver 53 of the winding creel 18.

Upon such a signal from the ultrasonic sensor 61 indicating that the cheese has not reached the transport device, the control computer 38 of the service unit 23 initiates a corresponding signal via the machine bus 40 to the winding station computer 39 of the respective winding station 2 which thereupon actuates the valve devices 43 and/or 44, so that the cheese brake 50 and/or the winding creel lifting device 49 are activated.

In particular, the winding station computer 39 preferably actuates the valve devices 43, 44 such that the cheese brake 50 and/or the winding creel lifting device 49 are actuated in a pulsed manner. Typically, the cheese is usually released from the winding creel by means of this pulse-like activation of the cheese brake 50 or of the winding creel lifting device 49 and then drops onto the swivel plate 20, whereupon, as already described above, the cheese 11 can then be transferred without a need for manual intervention to the cheese transport device 21.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A cheese-producing textile machine comprising a plurality of winding stations, each winding station having a winding station computer and an openable creel device for winding a cheese, the creel device having elements for holding and manipulating the cheese, a unit for servicing the winding stations, the servicing unit having a control computer and manipulating devices for removing a cheese from the creel device and for inserting an empty tube into the creel device of a respective winding station, and means for transmitting control signals between the winding station computers and the service unit computer, the service unit computer having means for issuing a control command to one of the winding station computers for the actuation of at least one of the cheese holding and manipulating elements thereof after opening of the creel device to assist in discharge of a finished cheese for replacement with an empty tube.

2. The cheese-producing textile machine in accordance with claim 1, wherein the cheese holding and manipulating elements include a cheese brake and a creel lifting device arranged to be actuable by the control computer of the service unit.

3. The cheese-producing textile machine in accordance with claim 2, and further comprising means for pneumatically operating the cheese brake, including a compressed air source, a service line extending between the compressed air source and the cheese brake, and a valve element in the service line, the control commands issued by the service unit computer being adapted to operate in a pulsed manner.

4. The cheese-producing textile machine in accordance with claim 2, and further comprising means for pneumatically operating the creel lifting device, including a compressed air source, a service line extending between the compressed air source and the creel lifting device, and a valve element in the service line, the control commands issued by the service unit computer being adapted to actuate the valve element in a pulsed manner to cause the creel lifting device to operate in a pulsed manner.

5. The cheese-producing textile machine in accordance with claim 1, wherein the means for transmitting control signals between the winding station computers and the service unit computer comprises a machine bus connecting the control computer of the service unit with the winding station computers and for transmitting the control commands issued by the service unit computer.

6. The cheese-producing textile machine in accordance with claim 1, and further comprising a cheese transport device for receiving finished cheeses from the winding stations, the service unit having a sensor device for detecting the receipt of finished cheeses by the cheese transport device and being connected to the service unit computer for transmitting a corresponding detection signal.

7. The cheese-producing textile machine in accordance with claim 6, wherein the sensor device is an ultrasonic sensor.

* * * * *